US005158246A

United States Patent [19]

Anderson, Jr.

[11] Patent Number: 5,158,246

[45] Date of Patent: * Oct. 27, 1992

[54] RADIAL BLEED TOTAL THRUST CONTROL APPARATUS AND METHOD FOR A ROCKET PROPELLED MISSILE

[76] Inventor: Carl W. Anderson, Jr., 7914 Springfield Village Dr., Springfield, Va. 22152

[ * ] Notice: The portion of the term of this patent subsequent to Jul. 2, 2008 has been disclaimed.

[21] Appl. No.: 676,265

[22] Filed: Mar. 27, 1991

Related U.S. Application Data

[63] Continuation of Ser. No. 271,504, Nov. 15, 1988, Pat. No. 5,028,014.

[51] Int. Cl.[5] ..... F42B 10/66

[52] U.S. Cl. ..... 244/3.22

[58] Field of Search ..... 244/3.22, 52, 55-57, 244/73 R, 74; 239/265.19, 265.25, 265.27, 265.29, 265.31

[56] References Cited

U.S. PATENT DOCUMENTS

| | | | |
|---|---|---|---|
| 2,726,510 | 12/1955 | Goddard | 244/3.22 |
| 3,034,434 | 5/1962 | Swaim et al. | 244/3.22 |
| 3,304,029 | 2/1967 | Ludtke | 244/3.22 |
| 3,350,886 | 11/1967 | Feraud et al. | 244/3.22 |
| 3,442,083 | 5/1969 | Klotz | 239/265.31 |
| 3,502,285 | 3/1970 | Gambill | 244/3.22 |
| 3,599,899 | 8/1971 | McCullough | 244/3.22 |
| 3,612,442 | 10/1971 | Chisel | 244/3.22 |
| 3,637,167 | 1/1972 | Froning, Jr. et al. | 244/3.22 |
| 3,740,003 | 6/1973 | Ayre et al. | 244/3.22 |
| 3,802,190 | 4/1974 | Kaufmann | 244/3.22 |
| 3,807,660 | 4/1974 | Le Corviger et al. | 244/3.22 |
| 3,926,390 | 12/1975 | Teuber et al. | 244/3.22 |
| 4,408,735 | 10/1983 | Metz | 244/3.22 |
| 4,712,747 | 12/1987 | Metz et al. | 244/3.22 |
| 4,726,544 | 2/1988 | Unterstein | 244/3.22 |
| 4,805,401 | 2/1989 | Thayer et al. | 239/265.27 |
| 5,028,014 | 7/1991 | Anderson, Jr. | 244/3.22 |

*Primary Examiner*—Charles T. Jordan
*Attorney, Agent, or Firm*—Kirkland & Ellis

[57] ABSTRACT

A radial bleed total thrust control system for a rocket propelled missile. In the preferred embodiment, the apparatus employs at least two pairs of straight radial nozzles which are disposed within and penetrate the skin of the missile and at least two pairs of tangentially canted radial nozzles which are also disposed within and penetrate the skin of the missile to provide control moments necessary to control the pitch, yaw, roll and/or the axial thrust of the missile. In one embodiment the radial and tangential nozzles are supplied by the same source of propelling gas as the main thrust nozzle, and in a second embodiment the straight radial and tangentially canted radial nozzles have a separate gas supply source.

9 Claims, 3 Drawing Sheets

RADIAL BLEED TOTAL THRUST CONTROL APPARATUS AND METHOD FOR A ROCKET PROPELLED MISSILE

This is a continuation of co-pending application Ser. No. 07/271,504 filed on Nov. 15, 1988, now U.S. Pat. No. 5,028,014.

FIELD OF THE INVENTION

The invention relates to flight vehicles, such as rocket-propelled missiles and the like (hereinafter collectively referred to as "missiles" or "flight vehicles"), and more particularly to a new and useful apparatus for producing control forces and moments about missiles to control the net pitch, yaw and roll motions of the missile as well as the total axial thrust of the missile.

BACKGROUND OF THE INVENTION

Propulsion systems of the future will involve missions requiring bold increases in performance over present systems. New and innovative concepts are therefore required to meet these future needs. The present invention relates to a completely new and unique apparatus for achieving missile total thrust control that offers the combined capabilities of very high side force control ("thrust vector control" or "TVC"), axial thrust modulation control ("thrust magnitude control" or "TMC") and roll control ("RC"), all within a compact nozzle system.

One of the principal disadvantages to the use of present day solid propellant engines in complex trajectory applications is their inability to effectively manage or vary the main (axial) nozzle thrust (i.e., TMC). This single attribute, in spite of the superior storability, simplicity and lower cost of solids, often leads to inefficiencies and system inflexibilities that can drastically limit missile system performance and/or necessitate the use of boost/sustain and other complex and expensive propellant grain designs to achieve thrust shaping.

Similarly, the inherent and strict mechanical limitations and the complexities of many present day TVC systems impose restrictions on the TVC system performance that can be obtained with these concepts. Side force magnitudes and reversal rates therefore limit missile system target acquisition and kill performance.

The present invention seeks to enhance TMC while supplying the added capability of very high side forces and very high side force reversal rates. Since motors equipped with the present invention can be designed to meet the unique axial and side force requirements of a specific mission, the performance of the resulting propulsion systems is not driven by specific subsystem limitations. This enables each missile propulsion system to be optimized to its own individual mission parameters.

High performance propulsion systems of the future must, therefore, have two major performance capabilities. These are energy management and maneuverability. These two primary capabilities when coupled with reliable and cost effective missile concept design approaches will result in missile systems of superior caliber. The present invention offers the capability of achieving both of these goals (plus roll control) in a single compact nozzle apparatus.

System performance studies involving the missions of future high performance missile systems show three irrefutable results. First, the vulnerability of the launching platform (aircraft, ship, tank, etc.) is measurably reduced with greater launch standoff distances. Second, the missile kill envelope is driven at the inner boundary by missile maneuverability (i.e., side force parameters) and at the outer boundary by missile range. And third, the largest single contributor to increased missile range results from reducing its aerodynamic drag coefficient. Aerodynamic wings and control surfaces necessarily cause increases in the missile drag coefficient.

With the present invention, aerodynamic drag is reduced, since no aerodynamic control surfaces are necessarily required. Also because of the present invention's TMC capability, it is often possible, by throttling down after the missile cruise speed has been achieved, to extend the missile range and the time of powered flight to target intercept and destruction. In so doing, the missile can maintain the minimum necessary control forces in powered flight and then throttle-up just prior to the target engagement to achieve the present invention's capability of extremely high side forces and side force reversal-rates for use during the target intercept phase.

One prior art disclosure for producing control moments in rocket-propelled missile systems is disclosed in Kaufmann U.S. Pat. No. 3,802,190, issued Apr. 9, 1974. Kaufmann discloses a rocket-propelled missile including a housing for a rocket engine having a plurality of control-nozzle assemblies attached to the outer skin of the missile around its periphery. Each assembly is continuously supplied with thrust gases, and includes a thrust discharge in the same direction as the main nozzle thrust and at least one additional thrust discharge extending outwardly in a tangential direction. No radial nozzles are present in the control nozzle assemblies. Control means are provided for controlling gas flow to the nozzles in each control nozzle assembly. In a further disclosed embodiment, each assembly is also provided with an axial nozzle having a thrust direction opposite to the main axial nozzle thrust to produce additional control moments. Gases are continuously directed to the control nozzle assemblies. Consequently, axial thrust is not modulated in Kaufmann through the diversion of gases from the main nozzle to the control nozzle assemblies.

The present invention offers numerous advantages over the prior art disclosed in Kaufmann. First, there are no control nozzles distributed over the missile surface, so there is no increase in the drag coefficient of the missile. Second, the control nozzles either increase the total net axial thrust of the missile, or do not affect the total axial thrust. Third, roll torque and pitch or yaw moments can be simultaneously produced. Fourth, the missile control moments are not limited by the physical radius of the missile. And finally, the present invention does not require a continuous flow of propellant gases through each nozzle control assembly for the entire fuel burning duration, so that heat buildup and material erosion/corrosion problems on the seals, Another missile control system is disclosed in Feraud et al. U.S. Pat. No. 3,350,886, issued Nov. 7, 1967. The disclosed system provides for the stabilization and guidance of rocket-propelled vehicles operating along powered or unpowered ballistic phases of flight.

This system is intended primarily for liquid fuel sounding rockets. In powered flight, pitch and yaw control are effected through liquid or gas-injection in the main propulsion nozzle supersonic flowstream to deflect the main jet or thrust vector to achieve side forces. Pitch and yaw control in ballistic flight and roll control in both powered and ballistic flight are achieved by selectively supplying compressed gas to a system of nozzles. The Feraud et al. disclosure does not allow unlimited freedom as to which nozzles can be opened and closed at the same time. For example, certain sets of nozzles can only be actuated in pairs, whereas other sets of nozzles allow only one or the other of a pair to be actuated at a single time. Also, Feraud et al. contains no suggestion of axial thrust modulation by flow diversion.

Accordingly, there is a need in the art for a missile control system that is capable of controlling pitch, yaw and roll forces and moments, as well as main nozzle axial thrust, without greatly increasing the weight, complexity or drag of the missile.

SUMMARY OF THE INVENTION

The present invention relates to an apparatus and method for controlling pitch, yaw and roll forces and moments applied to a missile which, in the preferred embodiment, has a main propulsion nozzle and a means for providing propelling gas to the main propulsion nozzle. In the preferred embodiment, the apparatus includes at least two pairs of straight radial nozzles which penetrate the skin of the missile, the individual nozzles of each of the pairs being diametrically opposed to one another. The preferred embodiment further includes at least two pairs of tangentially canted radial nozzles which penetrate the skin of the missile, the individual tangentially canted radial nozzles of each of the pairs being diametrically opposed to one another. Means are provided for directing propelling gas to the main jet propulsion nozzle and for selectively diverting propelling gas to the straight radial nozzles and the tangentially canted radial nozzles. Finally, the apparatus includes a plurality of means for independently opening and closing each of the straight radial and tangentially canted radial nozzles to control the net missile pitch, yaw and roll forces and moments and to control the total axial thrust of the missile by opening and closing selected ones of the straight radial and tangentially canted radial nozzles.

In a further embodiment of the invention, a plurality of circumferential rows of nozzles or one or more staggered circumferential rows of nozzles are utilized to improve missile maneuverability and/or to accommodate alternative missile packaging configurations.

In another embodiment of the invention, the straight radial and/or tangentially canted radial nozzles are angled in the direction of the main thrust axis along a preferred solid angle. Such angling of the nozzles causes the discharge from such nozzles to contribute to the axial thrust component of the main nozzle while still providing effective TVC and RC.

It is an object of the present invention to provide an apparatus and method for controlling the net pitch, yaw and roll forces and moments and the axial thrust of a missile.

It is a further object of the present invention to provide an apparatus and method for controlling the net pitch, yaw and roll forces and moments and the axial thrust of a missile without significantly increasing the aerodynamic drag of the missile.

It is a still further object of the present invention to provide an apparatus and method for controlling the net pitch, yaw and roll forces and moments and the axial thrust of a missile which is capable of generating very high side forces and which has very high side force reversal rates.

It is a still further object of the present invention to provide an apparatus and method for controlling the pitch, yaw and roll forces and moments and the axial thrust of a missile which is capable of implementing random pitch, yaw and roll forces and moments and axial thrust commands at high speed.

It is a still further object of the present invention to provide an apparatus and method for controlling the net pitch, yaw and roll forces and moments and the axial thrust of a missile which is capable of large modulations of the axial thrust such that missile trajectory shaping can be accomplished without significant alterations to the propellant grain.

It is yet a further object of the present invention to provide an apparatus and method for hovering a flight vehicle at a predetermined altitude at a preset position even in strong cross-winds.

These and other objects of the present invention will be apparent to one of ordinary skill in the art from the detailed description which follows.

DETAILED DESCRIPTION OF THE PREFERRED EMBODIMENT

Figure 1:
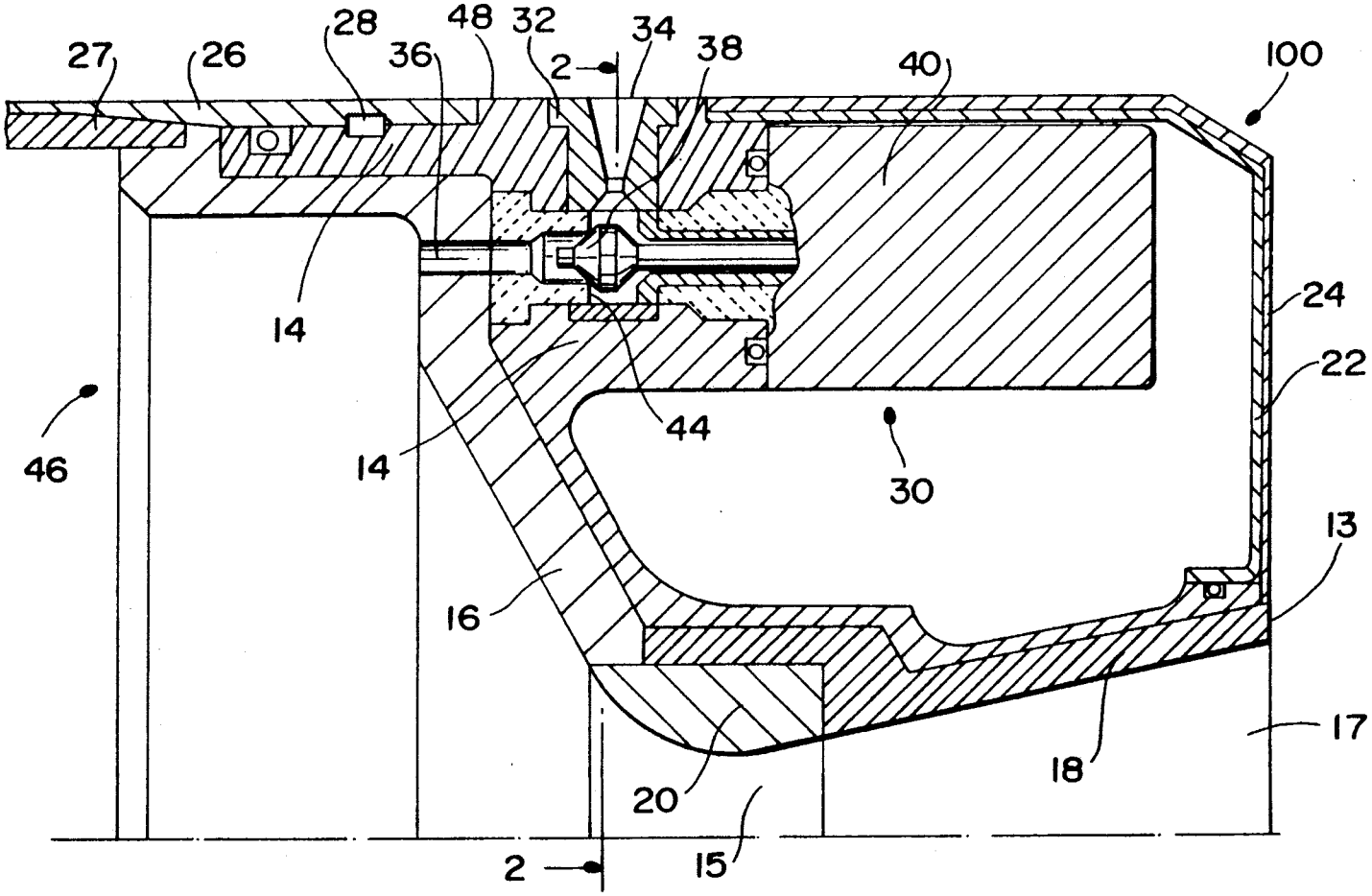
FIG. 1 is a side elevational partial cross-sectional view of a portion of the main nozzle of a jet-propelled missile embodying the present invention showing one radial control nozzle therein.

Referring now to FIG. 1, there is shown a cross-sectional view of a portion of the main propulsion nozzle 13 of a missile 100. The main propulsion nozzle 13 includes a throat 15 of an exit cone 17. The exit cone is defined by a nozzle housing 14 which is suitably insulated with entrance insulation 16, exit cone insulation 18 and a throat insert 20, formed of any suitable materials, so as to protect nozzle housing 14 from the extreme temperatures and pressures caused by the propelling gas as it passes through throat 15 and leaves exit cone 17. Also attached to nozzle housing 14 is cover 22 and cover insulation 24 which define an enclosure for valve means 30. Nozzle housing 14 is attached to a motor case 26 and is retained in position by an ortman key 28 or any other suitable means. Motor case 26 also includes motor case insulation 27 of any suitable material for protecting motor case 26 from the extreme temperatures and pressures of the propelling gas.

Mounted within nozzle housing 14 are a predetermined number of radial nozzles 32 which define radial nozzle exit cones 34. Radial nozzle exit cones 34 are connected to propellant passages 36 which have valve pintles 38 or the like of valve means 30 movable therein. Each valve pintle 38 is independently controlled by a solenoid 40 or other suitable means mounted within nozzle housing 14. As an illustrative example, each valve pintle 38 engages a pintle seat 44 in the closed position and is spaced from the pintle seat 44 when in its open position. As will be appreciated by those skilled in the art, the present invention is not limited to the disclosed pintle valve means and any suitable valve structure could be employed (e.g., spindle valves, gate valves, ball valves, etc.). Moreover, although solenoid actuating means are disclosed, any suitable actuator mechanism could be employed, including, e.g., servo actuators, pneumatic actuators, hydraulic actuators, etc.

In operation, gas from burning propellant (not shown) in area 46 of the missile flows rearwardly through throat 15 and out exit cone 17 of main propulsion nozzle 13 to generate the axial thrust which powers the missile. The propellant gas also flows through the propellant passage 36 where it encounters the valve pintles 38 for each respective nozzle 32. When valve means 30 are closed, no propellant gas flows into the respective radial nozzle exit cones 34 and thus no control force is produced. When valve means 30 are opened by the action of the solenoid 40 or other suitable control means on one or more of the valve pintles 38, propellant gas flows through propellant passages 36 into the radial nozzle exit cones 34 of the associated radial nozzle and out beyond the missile outer surface or skin 48 to create control forces and moments in directions opposite to the propellant gas flow.

Figure 2:
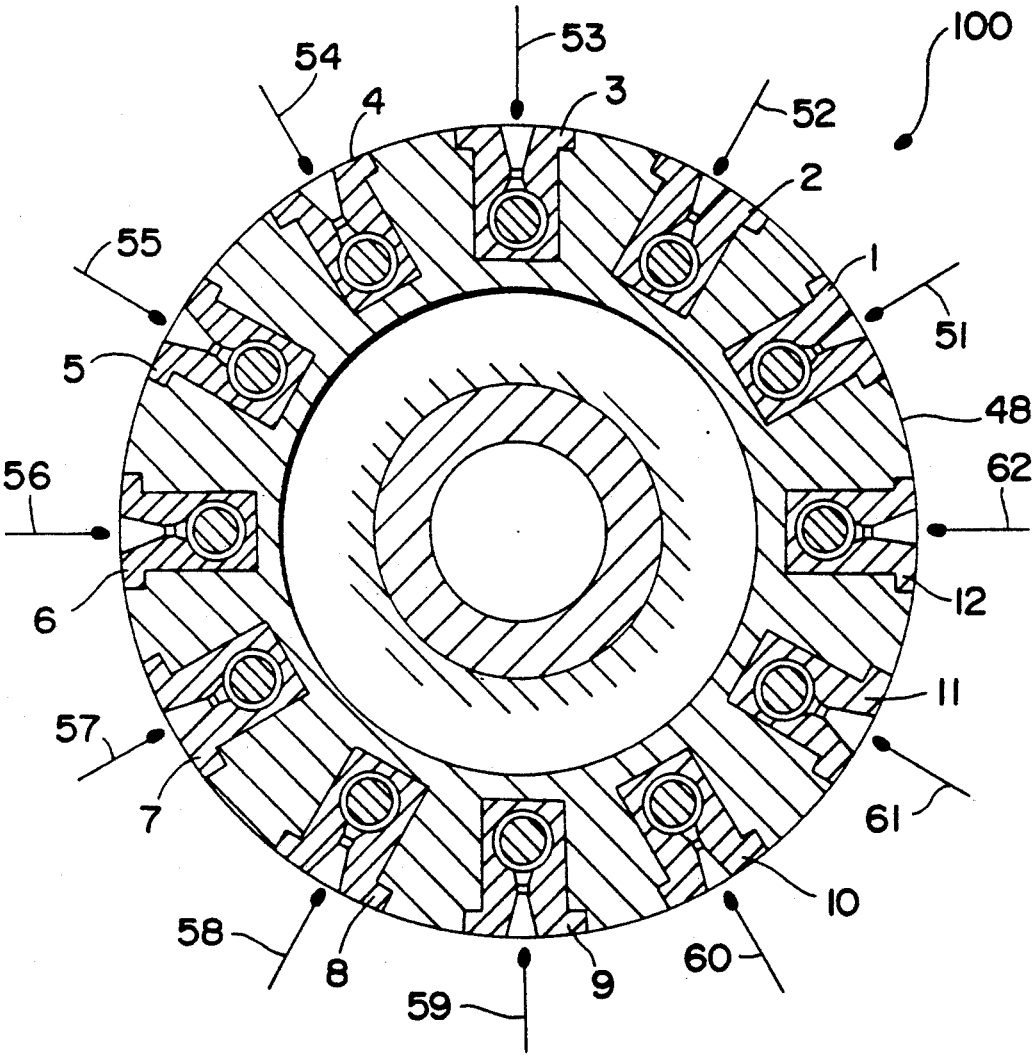
FIG. 2 is an end elevational cross-sectional view of the entire missile taken along the plane partially defined by line 2—2 of FIG. 1 showing a main nozzle having eight straight radial control nozzles and four tangentially canted radial control nozzles.

Referring to FIG. 2, there is shown a cross-sectional view of the entire missile 100 taken along the plane partially defined by line 2—2 of FIG. 1. The numerals 1–12 represent both straight radial and tangentially canted radial nozzles which penetrate the skin 48 of the missile. FIG. 2 shows the force vectors 51–62 which result from opening nozzles 1–12, respectively. As an illustrative example, nozzles 1, 2, 4, 5, 7, 8, 10 and 11 are straight radial nozzles, whereas nozzles 3, 6, 9 and 12 are tangentially canted radial nozzles. None of valve means 30 are shown in this diagram, although each of the twelve nozzles would have its own valve means, for example, of the type shown in FIG. 1 or of any other suitable construction.

Force vectors 51–62 depict the direction of force exerted by the opening of each of control nozzles 1–12. Thus, referring to FIGS. 3A–3F, the net side force 101 and moment 102 of opening two or more control nozzles 1–12 can be seen.

Figure 3A:
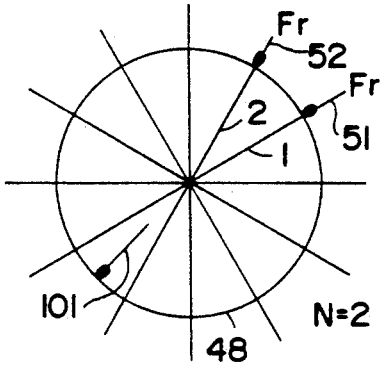
FIGS. 3A–F are force diagrams depicting the net forces and moments resulting from several exemplary straight radial and/or tangentially canted radial control nozzle opening configurations.

For example, in FIG. 3A, two adjacent straight radial nozzles 1, 2 are opened to produce the depicted net side force and no torque as depicted therein.

Figure 3B:
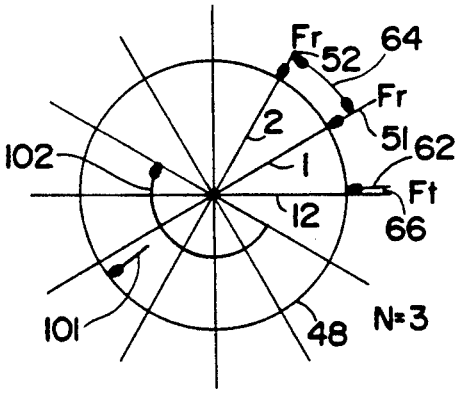

In FIG. 3B, the same two straight radial nozzles 1, 2 are opened and the tangentially canted radial nozzle 12 is opened to produce a slightly different net side force along with a clockwise torque as depicted in the FIGURE.

Figure 3C:
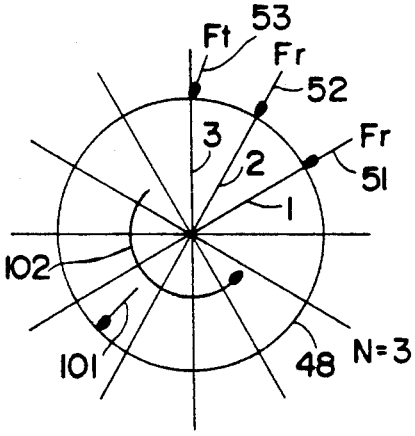

In FIG. 3C, straight radial nozzles 1 and 2 are opened along with tangentially canted radial nozzle 3 to produce a third different net side force and a counter-clockwise torque as shown therein.

Figure 3D:
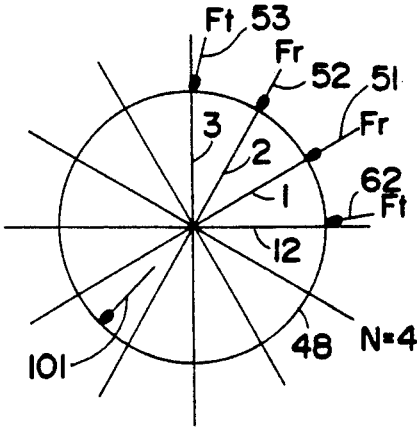

In FIG. 3D, again straight radial nozzles 1 and 2 are opened to produce a net side force. However, tangentially canted radial nozzles 3 and 12 are also opened, both of which add significantly to the net side force produced by nozzles 1 and 2. In this example, the torque of tangentially canted radial nozzle 3 exactly cancels the torque of tangentially canted radial nozzle 12 such that there is no net torque exerted by control nozzles 3 and 12. Accordingly, opening the four valves as shown in FIG. 3D produces a net side force in exactly the same direction as in FIG. 3A except that it will be of significantly greater magnitude than the side force of FIG. 3A.

Figure 3E:
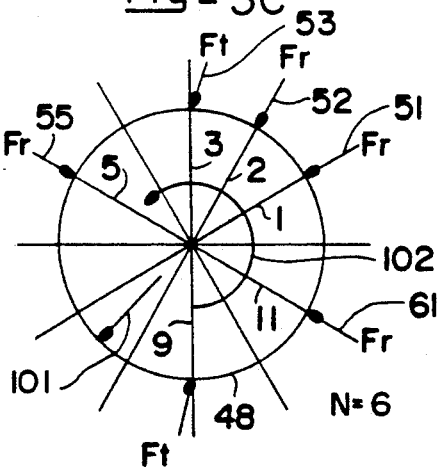

In FIG. 3E, straight radial nozzles 1, 2, 5 and 11 are opened along with tangentially canted radial nozzles 3 and 9. Radial nozzles 5 and 11 exactly cancel each other out. However, they serve the important effect of bleeding off some of the propelling gas and this will reduce slightly the force exerted by each of the remaining open nozzles as well as the total axial thrust of the main propulsion nozzle. Tangentially canted nozzles 3 and 9 cancel in the radial direction, but are additive to provide a finite counter-clockwise torque as shown in the figure. Thus, opening two tangentially canted radial nozzles which are directly opposed to one another (i.e., a pair) will produce a finite roll torque with no net side force. The net side force depicted in the figure is created solely by straight radial nozzles 1, 2. This net side force in FIG. 3E is less than the net side force in FIG. 3A because there are more nozzles open in FIG. 3E (i.e., six versus two), thereby reducing the thrust force exerted by each nozzle as compared with FIG. 3A. This reduction in net side force results because the radial nozzle flow area is three times greater (i.e., 6/2) in FIG. 3E as compared with FIG. 3A. This increase in flow area causes a reduction in pressure of the propelling gas and a corresponding reduction in the thrust output of each radial control nozzle.

Figure 3F:
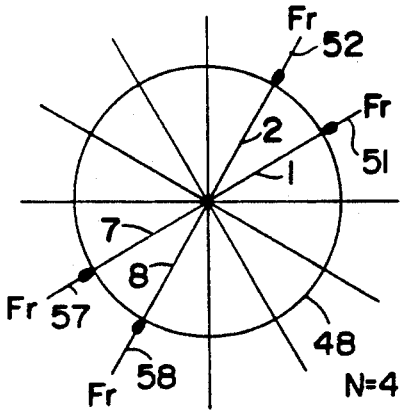

Referring to FIG. 3F, straight radial nozzles 1, 2, 7 and 8 are opened to produce a net reduction in the total axial thrust. No net side force is exerted since straight radial nozzles 1 and 2 exactly cancel straight radial nozzles 7 and 8. The opening of these four straight radial nozzles 1, 2, 7 and 8 will thus bleed some of the propelling gas away from main propulsion nozzle 13 to thereby reduce the total axial thrust of the missile without effecting TVC or RC.

Straight radial nozzles 1, 2, 4, 5, 7, 8, 10 and 11 must face radially outwardly from the center line of the missile 100 and main axial nozzle 13 such that the propelling gas directed through these straight radial nozzles will produce only a net side force and no net clockwise or counter-clockwise roll torque. Generally, the center line will coincide with the longitudinal axis of the missile. Radial control nozzles 1–12 are separated by a radial position angle 64 which, in the preferred embodiment shown in the drawings, is 30° such that control nozzles 1–12 are evenly spaced about the circumference of the missile skin 48. Generally, it would be desirable to divide 360° by the number of control nozzles to determine the radial position in order to evenly space the control nozzles. However, in some applications it may be desirable to unevenly space the control nozzles and thus the radial position angle 64 can be varied to any suitable size if a particular design will be improved by such a variation.

Tangentially canted radial nozzles 3, 6, 9 and 12 are also preferably evenly spaced about the circumference of missile skin 48. These tangentially canted radial nozzles do not face directly in the radial direction, but rather are canted from the radial direction by a torque angle 66. It has generally been found that small torque angles of 5°–15° are preferred since these small angles do not notably decrease the side force capability, but do provide adequate roll control torques. Other torque angles of up to 90° may be used depending on the requirements of the specific applications. For example, if the demands for roll torque are large, then the torque angle should be increased.

Another method for varying the magnitude of the control force created by each radial control nozzle is to employ proportional valve means 30 capable of precisely metering the quantity of the propelling gas bled through each of the control nozzles. In this manner, the magnitude of the control forces can be adjusted by selectively varying the amount of propelling gas admitted to each control nozzle 1–12 by the proportional action of the valve means 30. Although this embodiment may prove attractive for specific applications, it complicates the apparatus without providing significantly greater control of the missile. An acceptable level of missile control generally can be achieved by employing simple on-off valve means 30 provided at least twelve control nozzles are employed.

When thrust vector control (TVC) is required, the propelling gas is bled from control nozzles which produce the thrust in the desired thrust vector direction. Generally, the control moment is orthogonal to the direction in which the propelling gas is bled. When axial thrust magnitude control (TMC) is required, opposite pairs of control nozzles 1–12 are opened to bleed propelling gas away from the main propulsion nozzle 13 through the pairs of control nozzles 1–12 to thereby reduce the total axial thrust produced by the main propulsion nozzle 13. The radial pairs can be in any diametrically opposed location since they always cancel.

Additionally, a finer resolution of control forces and moments can be achieved with the present invention by implementing two or more circumferential rows of nozzles. In such an alternative embodiment, each specific nozzle would have a smaller thrust component and greater resolution in thrust forces could be achieved. Additionally, by spacing the rows of nozzles or by staggering a single row or a plurality of rows of nozzles in a preferred configuration, the moment arm of the radial thrust forces about the center of gravity of the missile can be varied, thus altering control performance. For example, a circumferential row of nozzles could be spaced fore and aft of the center of gravity for pitch and yaw control or around the center of gravity for transverse control forces without the introduction of moments. The spacing from the center of gravity alters the moment arm and hence the control performance.

Staggered circumferential rows of nozzles could also be utilized to accommodate packaging or housing peculiarities in a particular application.

While the preferred embodiment is disclosed as having twelve control nozzles, it will be appreciated that any number of pairs of radial straight radial nozzles greater than two can be utilized to effect TVC with the present invention. With a greater number of pairs of nozzles, a higher resolution of side forces is obtainable with the present invention. Such resolution, however, is obtained at the expense of cost, weight and complexity, with four pairs of straight radial nozzles being preferred. If proportional valving is employed, the straight radial nozzles need not be in pairs since offsetting control forces could be proportionally determined. For example, total TVC could be effected with only substantially equally spaced straight radial nozzles having a proportional control capability.

Additionally, any number of pairs greater than two of tangentially canted radial nozzles could be implemented in the present invention, again depending upon cost, weight and complexity considerations and the desired force resolution. Moreover, if required by a particular application, only two oppositely directed tangential nozzles could be implemented for clockwise and counter-clockwise roll control. In such an embodiment, the tangential nozzles could be oriented with a torque angle of 90° such that transverse forces could be directly offset by an opposing straight radial nozzle and pure roll control is effected. Alternatively, the straight radial nozzles could be sized or configured such that simultaneous actuation of specific straight radial nozzles would offset the transverse component from actuated tangentially canted radial nozzles to allow for pure roll control. Moreover, if proportional valve control is utilized, straight radial nozzle valves could be modulated to offset any transverse forces resulting from the tangentially canted radial nozzles to effect pure roll control.

Finally, any number of straight radial or tangentially canted radial nozzles can be angled about any acute solid angle with respect to an axis perpendicular to the main thrust (or longitudinal) axis (i.e., a radial axis). Such nozzles would thus supplement (or reduce) the main axial thrust component of the missile when actuated. In such an alternative embodiment, the control nozzles would still perform axial thrust modulation by bleeding off propelling gases from the main nozzle and redirecting them to provide a different axial thrust component.

In yet another embodiment of the invention, the main propulsion nozzle is eliminated and one, several or all of the control nozzles are angled about an acute solid angle with respect to the radial axis. In this embodiment, the control nozzles also provide the main thrust for the missile. Direction and axial thrust modulation are thus performed by altering the firing pattern of the control nozzles to vary the thrust vector of the missile.

Although the embodiments of the present invention which have been described thus far utilize a single source of propelling gas, separate sources of propelling gas could be employed for the control nozzles and the main nozzle. In such an embodiment, TVC and RC is performed in the manner described above. However, TMC does not automatically result from the actuation of the control nozzles. In this embodiment, TMC, if desired, must be separately provided for by separate bleed off valves or by conventional methods (e.g. grain design). Furthermore, the control nozzles of the present invention could be implemented in flight vehicles or missiles having alternative methods of main propulsion not implementing propelling gas which have applications where TVC and/or RC is required.

Furthermore, although described herein with respect to flight vehicles, it will be appreciated that the TVC and RC control apparatus and methods herein described have potential applicability to water vehicles as well (e.g., torpedoes and submarines). In water applications, liquid or gas could be expelled to perform TVC, RC and/or TMC.

The present invention provides future small to medium size missile systems with the capabilities of high side forces, high side force reversal rates, and energy management that are not limited by current mechanical nozzle thrust vector control systems because of the large mass and inertias involved in the motion of these present systems and the practical limitations imposed on the maximum available actuation system power to move them. The present invention solves these problems by employing valve means 30 having low pintle mass and short stroke, thereby effecting a high valve opening/-closing rate for a finite adequate amount of applied valve force. Further, because of the high speed at which the valve means 30 are opened and closed, high side force reversal rates are possible to thereby allow movement of a missile to a desired new trajectory position quickly through opening and closing selected ones of the radial control nozzles 1–12.

The present invention is applicable in all propulsion areas involving requirements for thrust management and high side forces and/or high side force reversal rates. Examples of such systems are ground-launched missile systems wherein target acquisition and system survivability are paramount. The present invention provides the ability to improve target acquisition and system survivability by allowing random axial thrust level commands to be implemented during an engagement to complicate and confuse engagement computations of the enemy deterrent. In present deterrent systems, engagement capabilities rely on proper target trajectory information to compute the engagement trajectory. This computation can be foiled by providing random axial thrust commands since prior target trajectory information will provide no indication of future movement of the target in this scenario.

The present invention is also useful in such areas as payload linkup and separation where precise calibration of thrust levels may be required. Similarly, mission operations in which trajectory shaping and missile range extension is useful would also benefit from the substantial axial thrust modulation capabilities of the invention.

The high side force and axial thrust modulation capabilities of the present invention can be employed both to enhance the capabilities to elude or engage the enemy deterrent. High side force engagement should, therefore, be advantageous in many systems involving countermeasures as Well as the transfer of payloads or launch platforms from one orbit to another.

Finally, the present inventions makes possible hovering missiles for use as decoys. The present system can be employed to reduce axial thrust to the level necessary to maintain altitude and radial control nozzles can be opened and closed periodically to maintain the missile in its precise location even in the presence of strong cross-wind effects. In this manner, radar and heat seeking missiles can be decoyed to the hovering missile rather than the intended target.

The invention can be controlled in any number of ways currently employed in the prior art. For example, from an onboard missile autopilot or automatic control means, from a ground-based beam rider or similar means or by the infusion of finite thrust and/or side force commands from a battle station or remote source by radio or microwave transmission link. Any of these processes would enable an onboard automatic fire control computer module to actuate solenoids 40 or other valve means and open and/or close selected radial control nozzles 1–12 throughout the flight of the missile. Other suitable control means known to those of ordinary skill in the art are also within the scope of the present invention.

As an illustrative example, the main axial nozzle throat insert 20 is preferably fabricated from a suitable heat-resistant material such as graphite, molybdenum or tungsten. Such throat inserts 20 are known to those of ordinary skill in the art. Exit cone insulation 18 is preferably a silica or carbon phenolic material as is the entrance insulation 16. Again, the materials used for entrance insulation 16 and exit cone insulation 1B are known to those of ordinary skill in the art of missile nozzle fabrication.

The nozzle hosing 14 is preferably fabricated from steel or other suitable materials known to those of ordinary skill in the art. Cover 22 is preferably aluminum and cover insulation 24 is preferably a rubber compound. Again, cover 22 and cover insulation 24 are standard parts which are known to those of ordinary skill in the art. Motor casing insulation 27 may be made of the same material as cover insulation 24. Motor case 26 and ortman key 28 are preferably fabricated from steel, whereas the valve pintles 38, pintle seats 44 and radial nozzles 32 are all preferably fabricated from vanadium, molybdenum or tungsten. However, recent developments in the field of composite materials may make possible the use of fiber-reinforced or metal-reinforced ceramic or ceramic matrix composites in place of many of the above-identified materials. The key factor is that the materials used to fabricate the various parts of the present invention must be capable of withstanding the extremely high pressures, temperatures and corrosive action of the propellant gases used to propel and control the missile.

The following examples are provided to illustrate embodiments of the present invention. They are not to be construed as limiting the invention in any way.

EXAMPLE 1

In this example, an air-launched missile is employed. Table 1 lists example forces and pressures accruing to the invention versus the number of radial control nozzles that are open at a given time.

TABLE 1

AIR LAUNCHED EXAMPLE
MOTOR PRESSURE,
NOZZLE THRUST LEVELS AND TVC ANGLE
versus
NUMBER OF RADIAL CONTROL NOZZLES OPEN

| Number Radial Control Nozzles Open | Motor Chamber Pressure (psia) | Axial Main Nozzle Thrust (1 bf) | Radial Control Nozzle Thrust (1 bf) | Maximum Thrust Vector Angle (degrees) |
|---|---|---|---|---|
| | Motor Temperature is −65 degrees F. | | | |
| 1 | 3368 | 4288 | 1734 | 22.0 |
| 2 | 1635 | 2081 | 841 | 38.0 |
| 3 | 918 | 1169 | 473 | 47.9 |
| 4 | 568 | 724 | 293 | 53.5 |
| 5 | 377 | 480 | 194 | 56.5 |
| 6 | 263 | 335 | 136 | 57.4 |
| 8 | 144 | 183 | 74 | 54.8 |
| | Motor Temperature is 70 degrees F. | | | |
| 1 | 4533 | 5771 | 2334 | 22.0 |
| 2 | 2200 | 2800 | 1132 | 38.0 |
| 3 | 1236 | 1574 | 636 | 47.9 |
| 4 | 765 | 974 | 394 | 53.5 |
| 5 | 507 | 646 | 261 | 56.5 |
| 6 | 354 | 451 | 182 | 57.4 |
| 8 | 193 | 246 | 100 | 54.8 |
| | Motor Temperature is +145 degrees F. | | | |
| 1 | 5346 | 6806 | 2752 | 22.0 |
| 2 | 2584 | 3303 | 1335 | 38.0 |
| 3 | 1458 | 1856 | 750 | 47.9 |
| 4 | 903 | 1149 | 464 | 53.5 |
| 5 | 598 | 762 | 308 | 56.5 |
| 6 | 418 | 532 | 215 | 57.4 |
| 8 | 228 | 290 | 117 | 54.8 |

EXAMPLE 2

In Example 2 a hovering missile is employed and the various parameters versus the number of radial nozzles open are listed in Table 2.

TABLE 2

HOVERING EXAMPLE
MOTOR PRESSURE,
NOZZLE THRUST LEVELS AND TVC ANGLE
versus
NUMBER OF RADIAL CONTROL NOZZLES OPEN*

| Number Radial Control Nozzles Open | Motor Chamber Pressure (psia) | Axial Main Nozzle Thrust (1 bf) | Radial Control Nozzle Thrust (1 bf) | Maximum Thrust Vector Angle (degrees) |
|---|---|---|---|---|
| | Motor Temperature is −25 degrees F. | | | |
| 0 | 3664 | 346.0 | — | — |
| 2 | 1693 | 159.8 | 47.1 | 29.7 |
| 4 | 1000 | 94.4 | 27.8 | 44.6 |
| 5 | 810 | 76.5 | 22.5 | 47.7 |
| 6 | 671 | 63.4 | 18.7 | 48.7 |
| 8 | 487 | 45.9 | — | — |
| 10 | 376 | 35.5 | — | — |
| | Motor Temperature is +125 degrees F. | | | |
| 0 | 5096 | 481.3 | — | — |
| 2 | 2355 | 222.3 | 65.5 | 29.7 |
| 4 | 1391 | 131.3 | 38.7 | 44.6 |
| 5 | 1127 | 106.4 | 31.3 | 47.7 |
| 6 | 933 | 88.2 | 26.0 | 48.7 |
| 8 | 677 | 63.8 | — | — |
| 10 | 523 | 49.4 | — | — |

*The listed values in the table occur at Motor Startup Conditions. For Motor Burnout Conditions multiply pressure and thrust values by 0.80.

EXAMPLE 3

Table 3 lists a typical force summary for control nozzles in the preferred embodiment of the present invention employing twelve control nozzles as illustrated in FIGS. 2 and 3A-3F.

TABLE 3

TYPICAL FORCE SUMMARY FOR RADIAL NOZZLES
($F_{Radial}$ = 27.8 1 bf, Nozzle Ring O.D. = 5.5", and Torque Angle = 10 Deg.)

| Radial Nozzle Number | Angle From Zero (deg.) | X Force Component (1 bf.) | Y Force Component (1 bf.) | Roll Torque Component (in-1 bf.) | Typical Angle From Wind Vector (deg.) |
|---|---|---|---|---|---|
| 1 | 30 | −24.07 | −13.90 | 0.0 | 169.8 |
| 2 | 60 | −13.90 | −24.07 | 0.0 | 161.2 |
| 3 | 90 | −4.83 | −27.38 | −13.48 | 131.2 |
| 4 | 120 | 13.90 | −24.07 | 0.0 | 101.2 |
| 5 | 150 | 24.07 | −13.90 | 0.0 | 71.2 |
| 6 | 180 | 27.38 | 4.83 | 13.48 | 41.2 |
| 7 | 210 | 24.07 | 13.90 | 0.0 | 11.2 |
| 8 | 240 | 13.90 | 24.07 | 0.0 | 18.8 |
| 9 | 270 | 4.83 | 27.38 | −13.48 | 48.8 |
| 10 | 300 | −13.90 | 24.07 | 0.0 | 78.8 |
| 11 | 330 | −24.07 | 13.90 | 0.0 | 108.8 |
| 12 | 360 | −27.38 | −4.83 | 13.48 | 138.8 |

The foregoing description of embodiments of the invention has been presented for purposes of illustration and description. It is not intended to be exhaustive or to limit the invention to the precise forms disclosed, and many modifications and variations will be obvious to one of ordinary skill in the art in light of the above teachings. The scope of the invention is to be defined by the claims appended hereto.

What is claimed is:

1. A method of controlling a gas propelled body having a main chamber, an axial thrust apparatus and a plurality of radial nozzles, comprising the steps of:

(a) generating a propelling gas flow in the main chamber;

(b) directing said propelling gas flow to said axial thrust apparatus;

(c) selectively diverting at least a portion of said propelling gas flow from said axial thrust apparatus to said plurality of radial control nozzles by selectively and independently opening and closing said radial control nozzles to control the direction and magnitude of the net force on the gas propelled body.

2. The method of claim 1, wherein said step of selectively diverting at least a portion of said propelling gas flow comprises selectively opening and closing radial control nozzles having offsetting side forces such that thrust modulation is effected, but the net side force on the body is zero.

3. The method of claim 1, wherein said step of diverting at least a portion of said propelling gas flow comprises selectively opening and closing radial control nozzles to effect a net side force on the body.

4. A method of controlling a gas propelled body to substantially hover at a location, comprising the steps of:

(a) producing a propelling gas flow in a main chamber;

(b) directing said propelling gas flow to at least one nozzle having an axial thrust component; and (c) bleeding at least a portion of said propelling gas flow to a plurality of control nozzles, and selectively and independently opening and closing said control nozzles such that the axial and side force components from said control nozzles substantially balance the external axial and side forces and moments on said body, such that the net force and net moment on said body are approximately zero.

5. A method of controlling a gas propelled body to substantially hover at a location, comprising the steps of:

(a) producing a propelling gas flow to at least one nozzle having an axial thrust component; and (c) bleeding at least a portion of said propelling gas flow to a plurality of control nozzles, and selectively and independently controlling the flow of propelling gas through each of said control nozzles such that the axial and side forces and moments from said control nozzles substantially balance the external axial and side forces and moments on said body, such that the net force and the net moment on said body are approximately zero.

6. A method of controlling a gas propelled body having a main chamber and a plurality of radial nozzles, comprising the steps of:

(a) generating a propelling gas flow in the main chamber;

(b) directing a portion of said propelling gas flow to a first group of said radial control nozzles by selectively and independently opening and closing nozzles of said first group of radial control nozzles to produce a net force and a net moment on said gas propelled body;

(c) adjusting the magnitude of the net force and the net moment on said gas propelled body by selectively opening and closing a second group of said radial control nozzles, wherein the net force and the net moment produced by said second group of radial control nozzles is zero.

7. A gas propelled body comprising:

(a) a main chamber wherein a propelling gas flow is generated;

(b) a plurality of radial control nozzles;

(c) means for directing a portion of said propelling gas flow to a first group of said radial control nozzles by selectively and independently opening and closing nozzles of said first group of radial control nozzles to produce a net force and a net moment on said gas propelled body; and (d) means for adjusting the magnitude of the net force and the net moment on said gas propelled body by selectively opening and closing a second group of said radial control nozzles, wherein the net force and the net moment produced by said second group of radial control nozzles is zero.

8. A method of controlling a gas propelled body having a main chamber and a plurality of radial nozzles, comprising the steps of:

(a) generating a propelling gas flow in the main chamber;

(b) directing a portion of said propelling gas flow to at least one of said radial nozzles by selectively and independently opening and closing nozzles of said radial nozzles to produce a net force and a net moment on said gas propelled body;

(c) adjusting the magnitude of the net force and the net moment on said gas propelled body by selectively opening and closing a group of said radial nozzles, said group not including the at least one nozzles opened and closed in step (b), wherein the net force and the net moment produced by said group of radial nozzles is zero.

9. A gas propelled body comprising:

(a) a main chamber for generating a propelling gas flow;

(b) a plurality of radial nozzles;

(c) means for directing a portion of said propelling gas flow to at least one of said radial nozzles by selectively and independently opening and closing nozzles of said radial nozzles to produce a net force and a net moment on said gas propelled body;

(d) means for adjusting the magnitude of the net force and the net moment on said gas propelled body by selectively opening and closing a group of said radial nozzles, said group not including the at least one nozzles opened and closed by the means recited in (c), wherein the net force and the net moment produced by said group of radial nozzles is zero.

* * * * *